US005904023A

United States Patent [19]

diGirolamo et al.

[11] Patent Number: 5,904,023

[45] Date of Patent: May 18, 1999

[54] STEEL STUD STABILIZING CLIP

[75] Inventors: Edward R. diGirolamo; Richard Mountcastle, both of Raleigh, N.C.

[73] Assignee: The Steel Network, Inc., Raleigh, N.C.

[21] Appl. No.: 09/008,044

[22] Filed: Jan. 16, 1998

[51] Int. Cl.[6] ..... E04B 1/38

[52] U.S. Cl. ..... 52/712; 52/481.1; 52/702; 52/508; 403/388; 403/399

[58] Field of Search ..... 52/702, 712, 715, 52/481.1, 508, 537; 403/388, 396, 398, 399, 400

[56] References Cited

U.S. PATENT DOCUMENTS

| | | | |
|---|---|---|---|
| 2,910,151 | 10/1959 | Millstine | 52/508 |
| 3,103,263 | 9/1963 | Lesser | 52/715 |
| 3,216,160 | 11/1965 | Best | 52/715 |
| 3,831,338 | 8/1974 | Klingensmith et al. | 403/400 |
| 4,932,173 | 6/1990 | Commins | 52/702 X |
| 5,457,928 | 10/1995 | Sahnazarian | 52/702 |
| 5,481,844 | 1/1996 | Kajita | 52/702 |
| 5,664,392 | 9/1997 | Mucha | 52/712 X |
| 5,669,198 | 9/1997 | Ruff | 52/715 X |
| 5,797,694 | 8/1998 | Brevik | 52/702 X |

OTHER PUBLICATIONS

Copy of page 18 from catalog published by Unimast Incorporated.

*Primary Examiner*—Christopher Kent
*Assistant Examiner*—Brian E. Glessner
*Attorney, Agent, or Firm*—Olive & Olive

[57] ABSTRACT

A novel clip for connecting each of a series of metal studs in a building wall to a metal channel passing through an opening formed in each stud. The clip is formed of a plate bent into a right angle. One section of the plate forms a saddle portion adapted to straddle and be secured to the channel. A second section of the plate is adapted to be attached to a wall stud. In a first embodiment, the second section has a pair of plates offset from each other so that one of the plates resides behind and the other plate resides in front of the web of the stud to which the plates are assembled. In a second embodiment, the clip has a single plate which is attached to the stud. A third embodiment includes a stiffening rib formed on each of two plates to improve the rigidity of the clip. The saddle portion and the plates in all embodiments are secured to a respective channel and stud by a screw, rivet or the like.

4 Claims, 4 Drawing Sheets

STEEL STUD STABILIZING CLIP

BACKGROUND OF THE INVENTION

1. Field of the Invention

This invention relates to steel stud building wall systems, and, more particularly to apparatus for stabilizing steel studs to prevent movement and twisting in such systems.

2. Description of the Related Art

Many industrial buildings and a growing number of residential buildings are being constructed with steel stud wall framing for the various benefits obtained, such as environmental quality, fire safety, freedom from warpage, insects, rust and rot. When building a wall with any stud, whether wood or steel, it is necessary to ensure that sequential such studs are held in fixed positions relative to each other and also that they do not tend to twist or move laterally. In wood-stud walls, a short wood piece is typically nailed in place between adjacent studs to stabilize each of the studs. In steel stud walls, a steel channel is typically inserted horizontally through a pre-punched opening in each of the vertically disposed studs to keep the studs aligned. Since a steel stud has relatively good columnar strength when straight, but loses a significant portion of this strength if twisted, the channel is made to fit the punched opening fairly snugly to minimize twisting. In addition to mechanical twisting, studs can twist or bend from the heat of a fire once the wall-surface drywall sheet has been destroyed. When the studs twist or bend, they effectively lose their ability to support weight, adding to the damage caused to the building from the fire.

While such a channel keeps the studs from twisting, it is not adequate to keep the studs from shifting or bending in a direction parallel to the wall being built. A simple right angle sheet metal bracket has been available to prevent this bending or shifting, although its installation is comparatively labor intensive. A user places the bracket with one section on top of the horizontal channel and the other section against a stud. Screws are inserted through the holes in each section to affix the angle to the stud and the channel. The bracket relies on the screws to accomplish its task, and relies on the installer for correct positioning.

It is therefore an object of the present invention to provide a stabilizing clip which is simple and easy to install for use in conjunction with steel studs and steel channels and which maintains the relative orientation therebetween.

Other objects and advantages will be more fully apparent from the following disclosure and appended claims.

SUMMARY OF THE INVENTION

The invention disclosed herein provides a clip for firmly connecting and stabilizing a building wall steel stud to a linear channel member which passes through an opening in each of a number of such studs in a wall section. The channel member is adapted, when installed through the studs, for keeping each of the studs in linear alignment. The invention provides a clip which has a first portion which straddles the linear channel member and a second portion perpendicularly connected to the first portion. In a first embodiment, the clip of the invention disclosed has a front plate for engaging a front surface of the stud and a rear plate connected to the front plate by a bridge and adapted for engaging a rear surface of the stud. The bridge passes through the opening in the stud. Holes are provided in each portion for the insertion of anchoring fasteners. In a second embodiment, the clip includes the straddle portion which is perpendicularly connected to a planar portion adapted for engaging the front surface of the stud with no part contacting the rear surface. The clip of the second embodiment is fastened to the channel member and the stud. The invention further provides a third embodiment having a front plate and a rear plate which are each formed with a stiffening rib and having a portion formed by drawing a pair of depending legs in a saddle plate for straddling the linear channel. This third embodiment allows the use of a lighter gage metal sheet without a significant loss of stiffness.

DETAILED DESCRIPTION OF THE INVENTION

Figure 1:
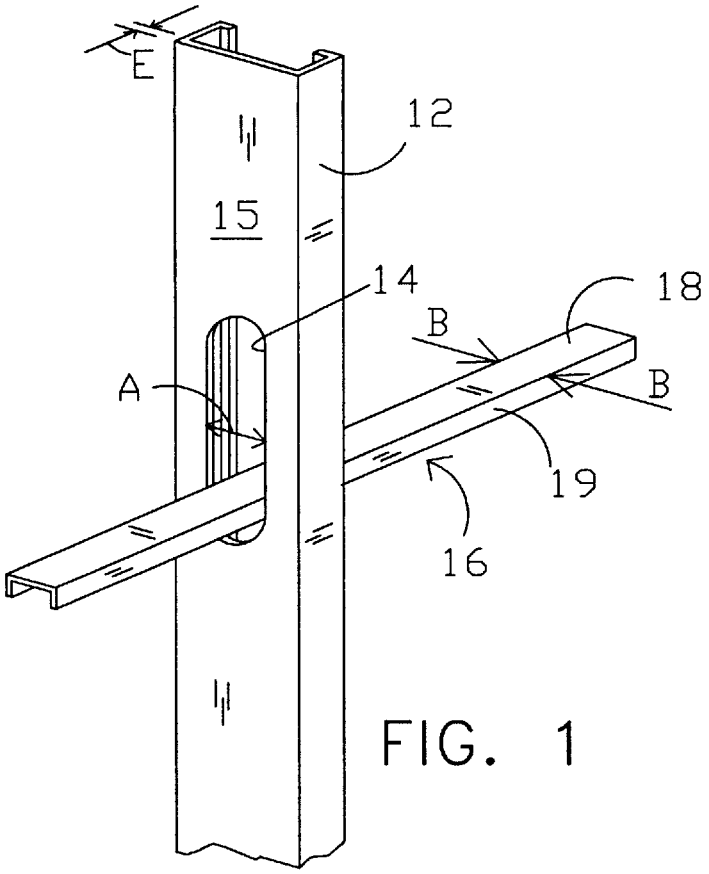
FIG. 1 is a perspective view of a portion of a steel stud with a steel channel inserted perpendicularly through an opening therein.

A steel stud 12, intended for use in a series of wall studs, is illustrated in FIG. 1 in connection with steel channel 16 passing perpendicularly through opening 14 formed in steel stud 12. Stud 12 and channel 16 are generally made of sheet steel having, for example, a thickness of 0.056 inches. Opening 14 is typically longer in the vertical direction than its width in the horizontal direction, as depicted in FIG. 1. Opening 14 is useful for passing cable or pipe through each stud 12 in addition to its function of permitting the interengagement between channel 16 and stud 12.

Typically, the width A of opening 14 is equal to or slightly greater than the width B of channel 16. Channel 16 comprises planar web 18 and a pair of parallel planar legs 19 connected to the long edges thereof. Channel 16 is preferably installed through stud 12 so as to be securely positioned close to the rounded bottom of opening 14 to further reduce movement of channel 16. Channel 16 is normally positioned in opening 14 with web 18 facing up and legs 19 facing down, as illustrated in FIG. 1.

Channel 16, as it is positioned through opening 14 of stud 12, will tend to reduce movement of stud 12 in a direction perpendicular to the length of channel 16. Channel 16 will not significantly reduce bending of stud 12 or movement in a direction parallel to the length of channel 16.

Figure 2:
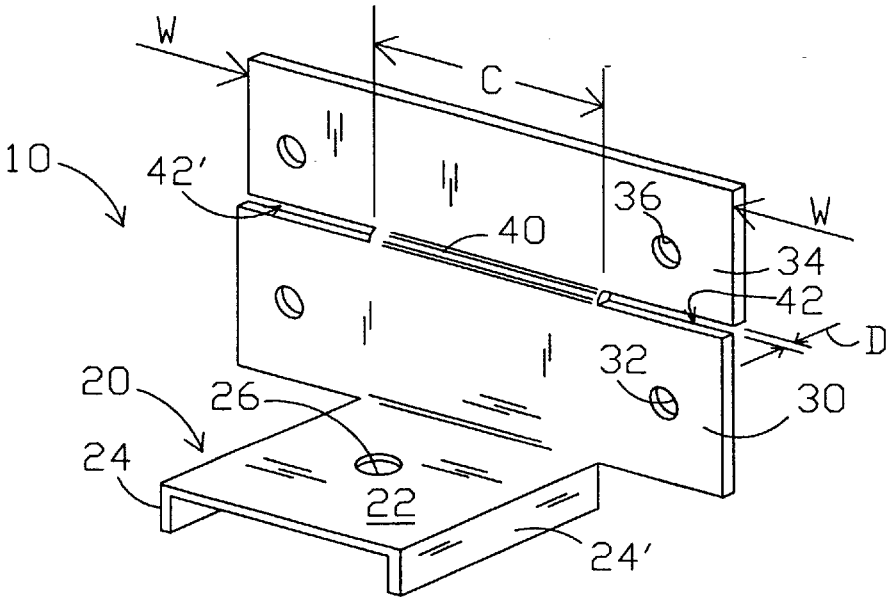
FIG. 2 is an enlarged perspective view of the stud stabilizing clip of the invention according to a first embodiment.

Referring now to FIG. 2, clip 10 of the present invention first embodiment is illustrated as being formed of a single piece of sheet steel similar to the material of which stud 12 and channel 16 are formed, which sheet is bent to a right angle between two main portions. The invention recognizes that alternate materials, such as, for example, plastics formed by injection molding of molten resin or by vacuum forming of sheet material, would serve the purpose intended. Clip 10 has a horizontal portion 20 formed in the shape of a channel with a horizontally oriented web 22 and vertically oriented legs 24 and 24' depending downwardly therefrom. Portion 20 is configured for being snugly mounted on channel 16, whether in its normal orientation with its web 18 up (see FIG. 1) or in reverse with its web 18 down (not shown).

Clip 10 is formed with a front plate 30 and a rearwardly offset rear plate 34 which are oriented substantially perpendicular to web 22. Front plate 30 and rear plate 34 reside in substantially parallel planes and are spaced apart by a bridge 40 connected therebetween. The length C of bridge 40, measured in a direction parallel to the joint between the two portions of clip 10, is substantially equal to the width A (FIG. 1) of opening 14. A pair of spaces 42 and 42' extend from either end of bridge 40 outwardly to each respective end of plates 30 and 34. The gap D, defining the space between front plate 30 and rear plate 34, is substantially equal to the thickness E (FIG. 1) of the web portion 15 of stud 12, or slightly greater. Clip 10 is formed with a series of holes 26, 32 and 36 in portions 20, 30 and 34 respectively which are sized for the insertion of screws or rivets for anchoring to stud 12 and channel 16. In use, only some of the holes may actually be used. A further embodiment (not shown) provides a clip formed with no holes, relying instead on holes being formed on the construction site.

Figure 3:
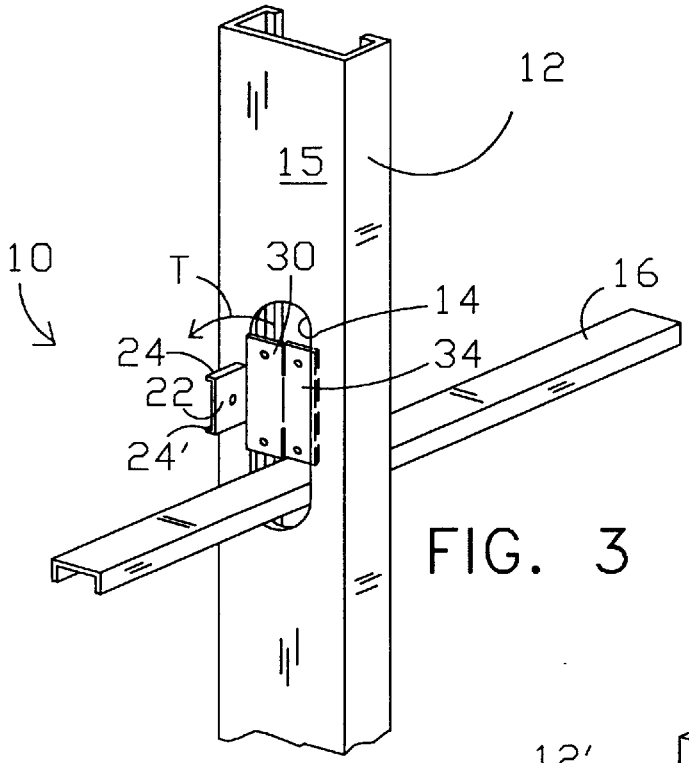
FIG. 3 is a perspective view of the steel stud and steel channel of FIG. 1 with the clip of the first embodiment inserted into the opening in the stud above the channel prior to being twisted and set down into engagement with the channel.
Figure 4:
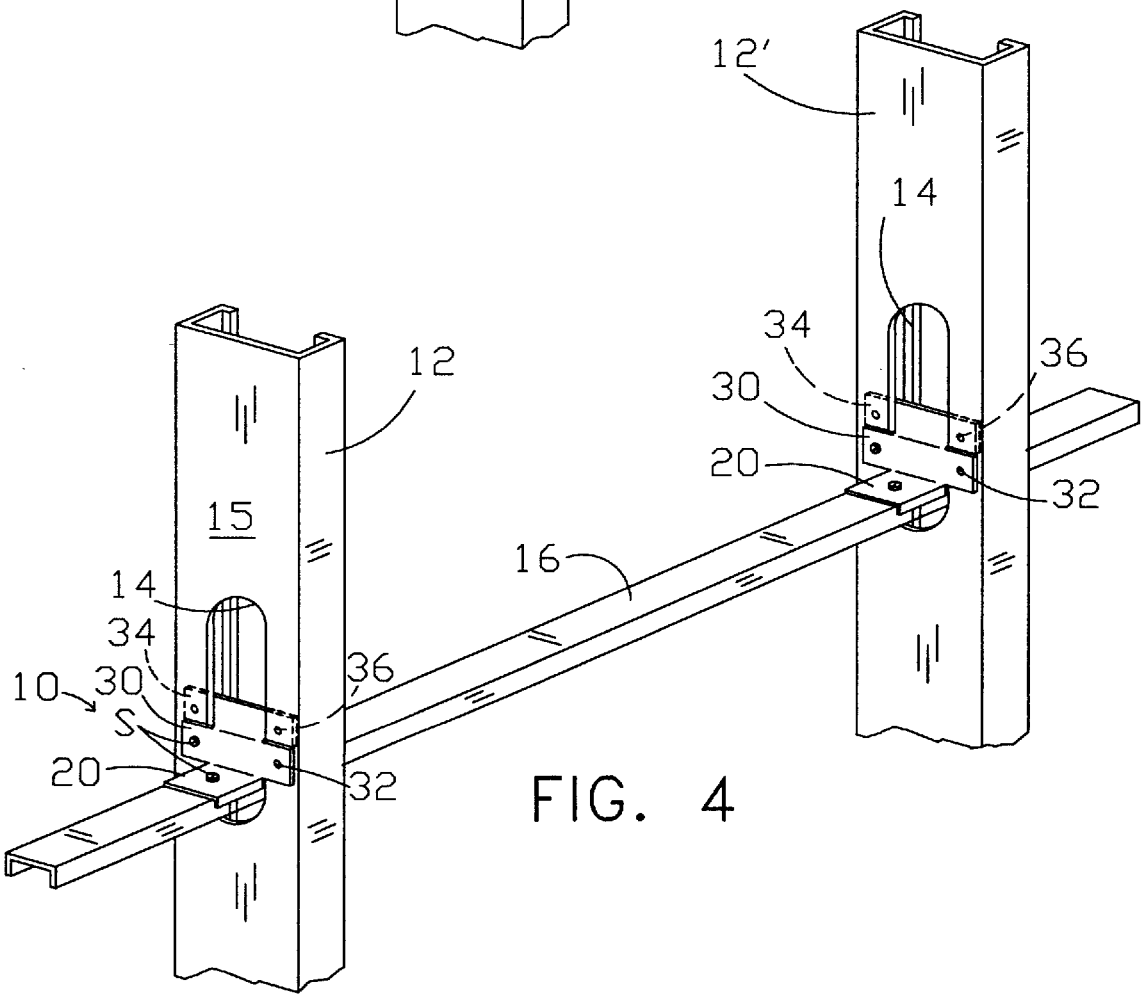
FIG. 4 is a perspective view of two partial steel studs of a building wall connected by a steel channel passing through an opening in each stud with the clip of the first embodiment mounted to connect and stabilize each stud to the channel.

The installation of clip 10 of the invention is illustrated best in FIGS. 3 and 4, to which the following description is directed. FIG. 3 is an illustration of stud 12 and channel 16, assembled as in FIG. 1, to which clip 10 has been added in an orientation substantially perpendicular to the position in which clip 10 will ultimately reside. As shown, clip 10 is first introduced to the assembly by being brought into contact with web 15 of stud 12 so that front plate 30 rides flatly thereon and rear plate 34 passes through opening 14. Width W of plates 30 and 34 (FIG. 2) is greater than width A of opening 14 and preferably less than width Z of stud 12 (FIG. 1). Optionally, plate 34 may be rounded at its upper corners (not shown). Next, clip 10 is rotated approximately 90 degrees in the direction shown by arrow T to position saddle legs 24 and 24' downward in a position over channel 16. Clip 10 is pressed downwardly so that legs 24 and 24' straddle channel 16 (See FIG. 4). This installation may begin with legs 24 and 24' facing either left (as shown) or right, with the direction of twist reverse from that illustrated.

Continuing with FIG. 4, one or more fasteners S, e.g., screws or rivets, are inserted through one or more of holes 26, 32, and 36 in clip 10 and secured into stud 12 and channel 16 respectively (unless self-drilling screws are used, matching holes must first be drilled in stud 12 or channel 16). If only a single fastener is used, it is best positioned through hole 32 in front plate 30 so that clip 10 keeps channel 16 pressed in its position against the bottom of opening 14 in stud 12. Preferably one screw S is fastened through hole 26 in web 20 and one screw S in a hole 32 in front plate 30. It is readily seen that rear plate 34 and front plate 30 sandwich web 15 of stud 12. A first fastener S may be secured through hole 32 and another fastener S is secured through hole 26 in web 20 to hold clip 10 against channel 16, securing stud 12 and channel 16 together. Additional screws through one or more of holes 32 and 36 may be used to increase the stiffness of the stud-and-channel system.

Figure 5:
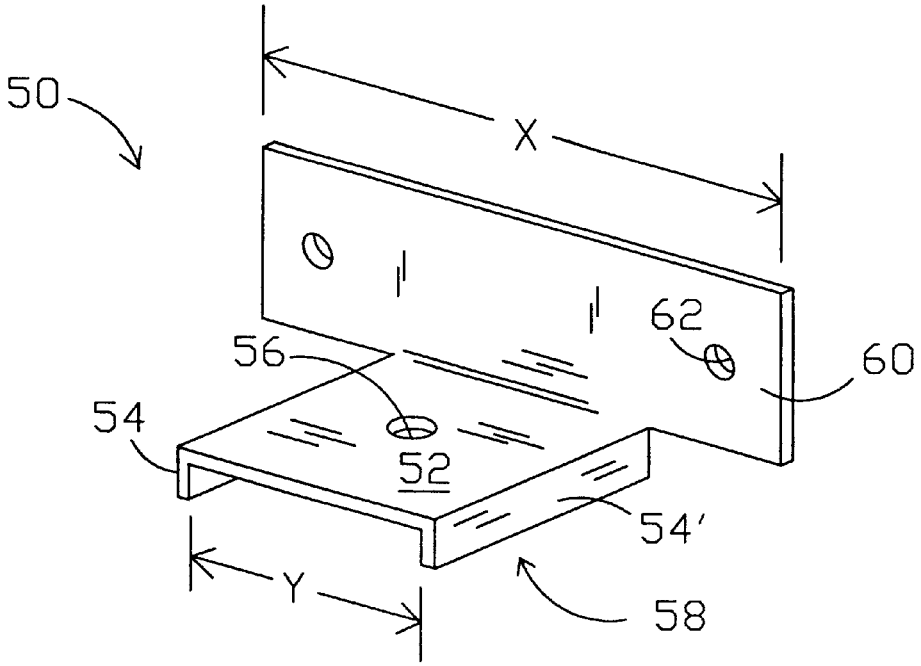
FIG. 5 is an enlarged perspective view of a stud stabilizing clip of the second embodiment.
Figure 6:
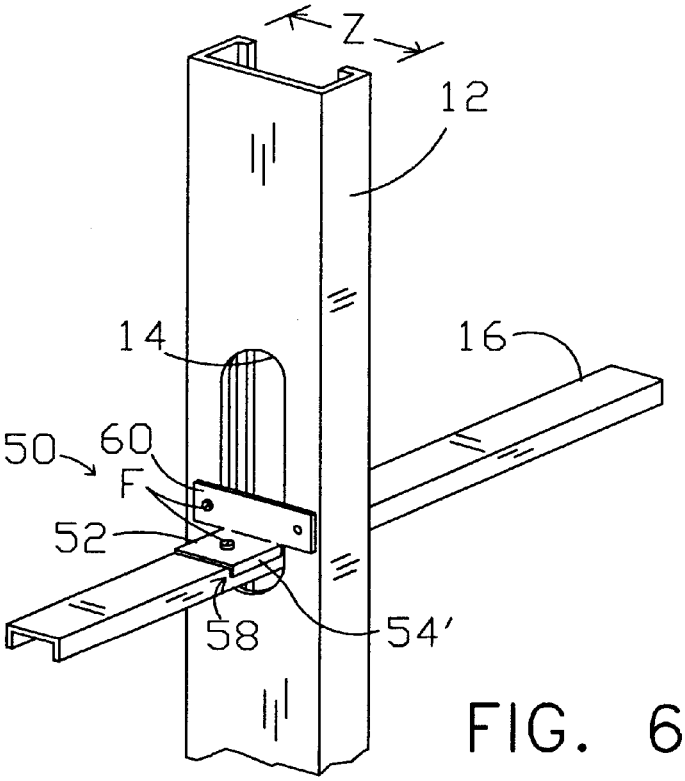
FIG. 6 is a perspective view of the steel stud and steel channel of FIG. 1 with the clip of the second embodiment assembled thereto.

The second embodiment of the invention is shown in FIGS. 5 and 6. FIG. 5 depicts clip 50 in an orientation as it is typically used. Clip 50 is formed from a single sheet of metal, preferably steel as noted above with reference to the first embodiment. A saddle 58 of clip 50 is formed as an inverted "U" having substantially planar web 52 with legs 54, 54' depending therefrom in perpendicular relation. The width Y between leg 54 and leg 54' is adapted to snugly mount onto channel 16 when assembled as illustrated in FIG. 6.

Plate 60 is formed integral with web 52 and oriented perpendicular thereto. Width X of plate 60 is greater than width Y of saddle 58 of clip 50, and width X is preferably less wide than the width Z (FIG. 6) of the steel stud 12 to which clip 50 is assembled.

As best seen in FIG. 5 of this second embodiment, plate 60 is formed with two holes 62 therethrough and web 52 has one hole 56. The orientation of clip 50 parallel to channel 16 is maintained primarily by legs 54 and 54' contacting the side edges of channel 16. As in the first preferred embodiment disclosed above, clip 50 can optionally be formed without holes, allowing hole formation to be accomplished during installation by drilling, for example.

A typical arrangement showing clip 50 operatively assembled so as to stabilize channel 16 and stud 12 is shown in FIG. 6. Saddle 58 is placed upon channel 16 with legs 54 and 54' positioned on either side thereof. Plate 60 is pressed against the surface of stud 12 and a series of fasteners F, such as screws, are driven through stud 12 and channel 16 respectively. In this condition, the relative orientation and position of stud 12 and channel 16 is secured.

Figure 7:
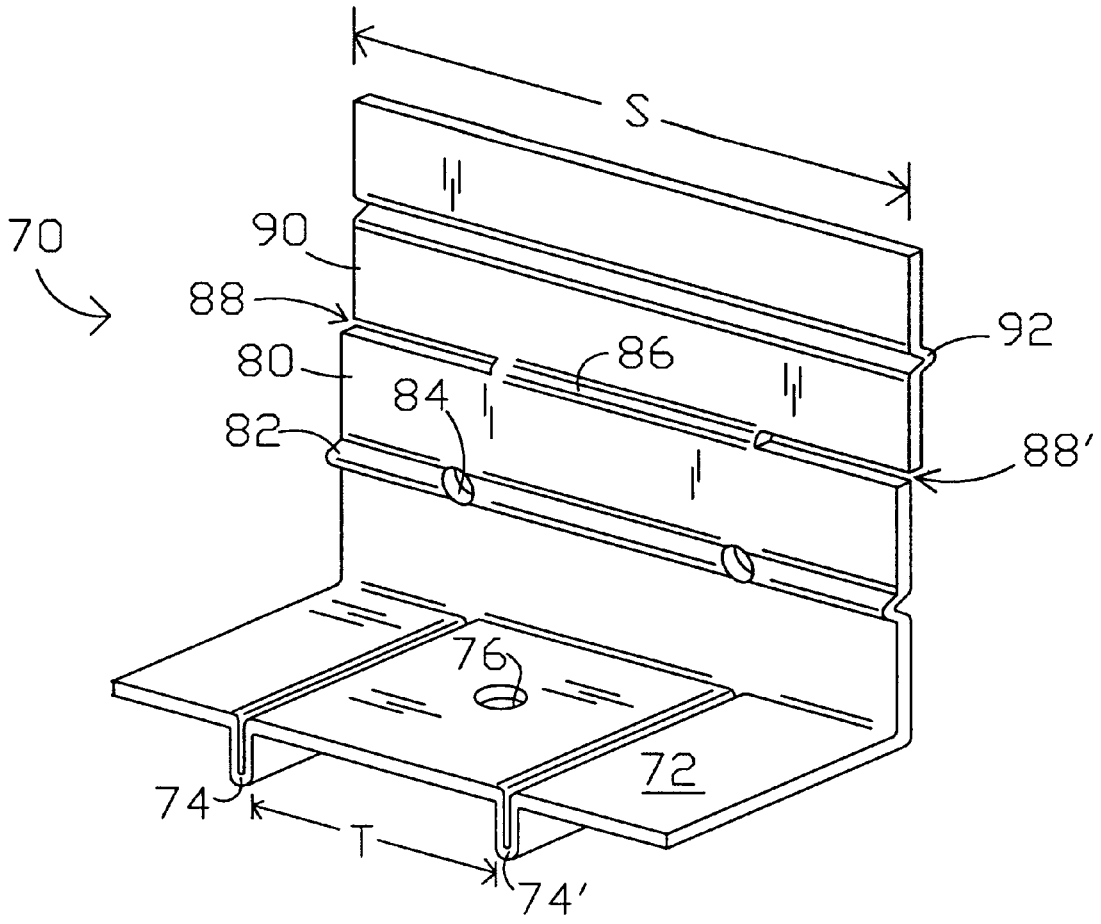
FIG. 7 is an enlarged perspective view of a stud stabilizing clip of the invention according to a third embodiment.

The clip according to a third embodiment is shown in FIG. 7. No drawings are provided of this third embodiment of the invention clip in assembly with steel studs since such drawings would be substantially duplicative of the description in relation to the first embodiment hereof.

As illustrated in FIG. 7, clip 70 is formed of a sheet of metal as described above. In this third embodiment invention clip 70, width S is substantially consistent throughout the vertical and horizontal portions thereof. The initial flat blank for clip 70 is preferably formed by stamping and punching operations to establish various punched and bent features. Subsequently, clip 70 is bent to form a perpendicular juncture between saddle plate 72 and front plate 80, with rear plate 90 residing parallel to and rearwardly offset from front plate 80. Saddle plate 72 has a pair of legs 74, 74' depending therefrom, each being in a narrow "V" configuration. Preferably, the portion of each leg 74, 74' facing the opposite leg is perpendicular to the plane of saddle plate 70. The width T between legs 74 and 74' is adapted to straddle channel 16 (see FIG. 4). Thus, as illustrated, width S is greater than width T and extends laterally outward beyond each of legs 74 and 74'. A hole 76 is formed in the portion of saddle plate 72 between legs 74 and 74' for insertion of a fastener, as described above.

Front plate 80 and rear plate 90 are joined by bridge 86, with spaces 88 and 88' on either side thereof. A stiffening rib 82 is formed as a relatively wide "V" across front plate 80 substantially parallel to the bend between saddle plate 72 and front plate 80. Rib 82 is preferably formed on front plate 80 to extend outwardly therefrom in the same direction as saddle plate 72. A pair of fastener holes 84 are formed through front plate 80, either through rib 82 (as shown) or adjacent thereto. A stiffening rib 92 is formed as a relatively wide "V" across rear plate 90 substantially parallel to rib 82 in front plate 80. Rib 92 is preferably formed so as to extend outwardly from rear plate 90 opposite to the direction of saddle plate 72. As will be understood by those skilled in the art, stiffening ribs 82 and 92 serve to stiffen respective plates 80 and 90 to allow clip 70 to be formed of a lighter gage metal sheet than otherwise. By orienting rib 82 and rib 92 in opposite directions relative to plates 80 and 90, the major flat portions of each such plate are in contact with the stud web to which clip 70 is mounted. The assembly of clip 70 to a stud is similar to that described above in relation to FIGS. 3 and 4 wherein first embodiment clip 10 is mounted to connect stud 12 and channel 16.

By providing a clip for efficiently and reliably securing studs to channel members with a simple insertion, twist, and mounting of one or more screws, the above noted objects of the invention are adequately satisfied.

While the examples above are offered as first, second, and third embodiments, it is not to be construed as a limitation of the scope of the invention which will become apparent from the claims appended hereto.

What is claimed is:

1. A clip for stabilizing a building wall system made up of a metal u-shaped channel which is positioned through an opening in each of a series of metal studs and arranged such that respective web portions of the channel and studs are in perpendicular relation, said clip being adapted to attach an individual one of said series of studs to said channel and comprising:

(a) a saddle portion having a web and a pair of legs depending therefrom, said legs being separated by a space adapted for straddling said channel;

(b) a first planar portion formed substantially perpendicular to and connected to the web of said saddle portion and extending laterally beyond said pair of legs;

(c) a second planar portion residing to and offset from said first planar portion, and said first and second planar portions being connected by a bridge residing in a plane substantially parallel to said web of said saddle portion; and (d) means enabling said first planar portion to be attached to a web portion of said one of said series of studs.

2. The clip as claimed in claim 1, wherein said bridge has a length adapted for being positioned laterally in said opening in each said stud.

3. The clip as claimed in claim 1 further comprising a first stiffening rib formed on said first planar portion and a second stiffening rib formed on said second planar portion, said first and second stiffening ribs each being formed substantially parallel to said web of said saddle portion.

4. The clip as claimed in claim 3 wherein said first stiffening rib extends outwardly from said first planar portion in the direction of said saddle portion and said second stiffening rib extends outwardly from said second planar portion in a direction opposite to the direction of said saddle portion.

* * * * *